US011060346B2

(12) United States Patent
Chuang

(10) Patent No.: US 11,060,346 B2
(45) Date of Patent: Jul. 13, 2021

(54) WINDOW CURTAIN

(71) Applicant: Shan-Chi Chuang, New Taipei (TW)

(72) Inventor: Shan-Chi Chuang, New Taipei (TW)

( * ) Notice: Subject to any disclaimer, the term of this patent is extended or adjusted under 35 U.S.C. 154(b) by 23 days.

(21) Appl. No.: 16/597,622

(22) Filed: Oct. 9, 2019

(65) Prior Publication Data

US 2021/0017808 A1 Jan. 21, 2021

(51) Int. Cl.
*E05D 15/26* (2006.01)
*E06B 9/04* (2006.01)

(52) U.S. Cl.
CPC ..... *E06B 9/04* (2013.01)

(58) Field of Classification Search
CPC .... E06B 9/326; E06B 9/24; E06B 2900/2458; E06B 9/364; E06B 9/32; E06B 9/36; E06B 9/367; A47H 15/02; A47H 2001/047; A47H 2023/025; A47H 15/00; A47H 7/02; A47H 1/04; A47H 5/032; A47H 13/00; A47H 2001/006; A47H 23/00; A47H 1/122; A47H 1/124
USPC ..... 160/330, 349.1, 332, 168.1 V, 168.1 R, 160/126, 197, 201; 49/125
See application file for complete search history.

(56) References Cited

U.S. PATENT DOCUMENTS 5,109,910 A * 5/1992 Tortorella ..... A47H 15/04 160/197
6,892,783 B1 * 5/2005 Comeau ..... A47H 1/08 160/126
8,708,026 B2 * 4/2014 Graves ..... A47H 5/0325 160/330
9,631,409 B2 * 4/2017 Wang ..... E05D 15/0639
10,307,007 B2 * 6/2019 Thomas ..... A47K 3/38
2008/0083511 A1 * 4/2008 Hung ..... E06B 9/32 160/168.1 R
2012/0000617 A1 * 1/2012 Chu ..... E06B 9/24 160/349.1
2013/0037504 A1 * 2/2013 Graves ..... A47H 1/022 211/124
2013/0068405 A1 * 3/2013 Lava ..... E06B 9/78 160/321
2019/0183276 A1 * 6/2019 Pang ..... A47H 5/02
2020/0256123 A1 * 8/2020 Chuang ..... E06B 9/326

* cited by examiner

*Primary Examiner* — Chi Q Nguyen
(74) *Attorney, Agent, or Firm* — Che-Yang Chen; Law Office of Michael Chen

(57) ABSTRACT

A window curtain may include a top track, at least a sliding unit, and a plurality of shades, and the top track has at least two track rods sleeved together, which reduces the packaging and shipping costs. Each of the track rods is hollow to form a channel therein, and the channel comprises two vertical guide tracks. The sliding unit comprises a plurality of first sliding bases formed in parallel, and each of the first sliding bases other than the innermost one is connected to a second sliding base. Each of the second sliding bases comprises a pulley support, and each of the pulley supports has at least a pulley set installed thereon. The pulley sets are adapted to slide along the track rods through the guide tracks which have no height difference so as to improve the smoothness of sliding movement of the pulley sets.

3 Claims, 19 Drawing Sheets

WINDOW CURTAIN

FIELD OF THE INVENTION

The present invention relates to a window curtain and more particularly to a window curtain having the advantages of low-packing-volume and high practicability.

BACKGROUND OF THE INVENTION

Referring to FIG. 22, a conventional window curtain (40) comprises a supporting base (41), and a plurality of sliding tracks (42) are arranged in parallel on the supporting base (41) (presented by three sliding tracks in figure). Each of the sliding tracks (42) is coupled with a track rod (43), and two pulley sets (431) respectively installed on an upper end of the track rod (43) are adapted to slide in and along the sliding track (42). Moreover, each of the track rods (43) is connected to a shade (44), and a pulling cord (45) installed on the supporting base (41) is configured to drive one of the pulley sets (431). A plurality of locating pieces (432) are alternately arranged on the track rods (43) to limit the moves of the track rods (43) in the sliding tracks (42).

However, the conventional window curtain mentioned above is disadvantageous because: The track rod (43) is slidably installed in the sliding track (42) of the supporting base (41) through the pulley set (431), so that the width of the sliding track (42) must be enlarged to fit the size of the pulley set (431), which increases assembly difficulty, the manufacturing cost, and packing size of the supporting base (41).

Referring to FIGS. 23 to 25, another conventional window curtain comprises an upper track (50) having an inner track (51) and an outer track (52), and the inner track (51) and the outer track (52) are hollow to respectively form a first channel (511) and a second channel (521) therein. Also, the first channel (511) and the second channel (521) respectively have a first elongated opening (512) and a second elongated opening (522) at bottom portions thereof. Each of two sides of the first elongated opening (512) comprises a horizontal first guiding track (513) while each of two sides of the second elongated opening (522) has a horizontal second guiding track (523), and each of the first guiding track (513) and the second guiding track (523) is adapted to load at least a wheel (53) of a shade so as to achieve opening and closing of the window curtain.

However, the conventional window curtain has following disadvantages: The inner track (51) and the outer track (52) of the upper track (50) are connected to enable the first guiding track (513) and the second guiding track (523) to have overlapped. Thus, the connection of the inner track (51) and the outer track (52) is adapted to have height difference, and when the wheel (53) moves between the inner track (51) and the outer track (52), the height difference is configured to affect the smoothness of sliding of the shade, which is inconvenient and noisy when used. Therefore, there remains a need for a new and improved design for a window curtain to overcome the problems presented above.

SUMMARY OF THE INVENTION

The present invention provides a window curtain which comprises a top track, at least a sliding unit, and a plurality of shades. The top track comprises at least two track rods sleeved together, and each of the track rods is hollow to form a channel therein. A bottom portion of the channel has a first elongated opening, and the channel comprises two vertical guide tracks respectively formed at two lateral edges of the first elongated opening toward an inner space of the channel. A locating cover and a cord cap are respectively secured at two ends of the top track, and a horizontal accommodating slot is formed inside the locating cover. Each of an upper surface and a lower surface of the accommodating slot has a locating recess located at corresponding positions. A wheel is horizontally positioned into the accommodating slot, and the position of the wheel is limited by the locating recesses. The cord cap comprises two vertical partitions formed therein to form two vertical accommodating spaces in the cord cap, and a bottom portion of the cord cap has two second elongated openings respectively located at positions corresponding to the two accommodating spaces, and a protruded connecting portion is formed between the two second elongated openings. Each of the accommodating spaces is adapted to receive a first pulley, and a mandrel is adapted to laterally penetrate through the cord cap to pivotally connect the first pulleys with the cord cap. A lift cord is disposed between the wheel and the two first pulleys, and an end of the lift cord is adapted to pass through the second elongated opening to downwardly hang outside of the cord cap. The cord cap is secured on an end of the top track, and the connecting portion is engaged in the first elongated opening, and the connecting portion is cooperated with a first lock piece and a first bolt to secure the cord cap with the top track.

The sliding unit comprises a plurality of first sliding bases formed in parallel, and each of the first sliding bases has two lateral surfaces respectively comprising a first locating groove and a second locating groove. A top end of the first sliding base has a connecting board while a bottom end thereof comprises a shade slot. A sliding block is formed at a rear end of the first locating groove which is located close to the cord cap, and the thickness of the sliding block is greater than the depth of the first locating groove. The sliding block is slidably coupled in the second locating groove of one adjacent first sliding base. A locating block having an elastic buffering piece is formed at a front end of the second locating groove which is located close to the locating cover so as to limit the moving space of the sliding block. A front end of the locating block is pivotally connected to a second blocking piece which is rotatable to block a front end of the shade slot. The connecting boards of the first sliding bases are formed in parallel, and each of the connecting boards comprises at least a connecting hole. The innermost of first sliding base has two connecting holes and two locating bases, and each of the first sliding bases other than the innermost one is connected to a second sliding base through the connecting hole. Each of the second sliding bases comprises a pulley support, and the lengths of the pulley supports are gradually decreased from the outermost to the innermost one, and each of the pulley supports has at least a pulley set installed thereon. The outermost of first sliding base comprises a plurality of connecting holes to enable the corresponding second sliding base to change secured position. The outermost of second sliding base comprises two pulley sets installed thereon, and a through hole formed between the two pulley sets is configured to be passed through by the lift cord for knot. When the first sliding bases of the sliding unit are at unexpanded positions, the second sliding bases with the pulley sets are aligned and coupled one by one. One of the locating bases of the innermost of the first sliding base is abutted against the second sliding base of the second from the innermost of the first sliding base, and the locating bases and the second sliding bases of the first sliding bases are slidably coupled into the channel of the top track. The pulley sets of the second sliding bases are respectively slid along the connected guide tracks, and each of the two locating bases of the innermost of the first sliding base is cooperated with a second lock piece and a second bolt to be secured with the guide track of the top track.

Each of the shades comprises a first mount bar and a second mount bar respectively formed at an upper end and a lower end of the shade, and each of the first mount bars is inserted into the shade slot of the first sliding base while each of the second mount bars is coupled into a bottom track. Each of the bottom tracks is formed into a U-shape, and a first slot is formed therein. Each of two outer lateral sides of the bottom track has an abutting edge, and two top ends of the two abutting edges are respectively inwardly bent by 180 degree to form two locating boards, and each of the two locating boards is sloped toward each other to enable the abutting edges to be slightly expanded outwardly. An end of the locating board is bent to form a blocking portion, and each of two ends of the bottom track is connected to a first cover.

In one embodiment, an outer end of the sliding block has two locating pieces formed in parallel, and the sliding block is slidably coupled in the second locating groove of one adjacent first sliding base through the locating pieces, and a first blocking piece is extended from a lower end of the sliding block so as to block a rear end of the shade slot.

In another embodiment, the front end of the locating block has a column protruding out of the second locating groove, and the column is configured to pivotally connect to the second blocking piece.

Comparing with conventional window curtain, the present invention is advantageous because: (i) with the different lengths of pulley supports, the pulley sets and the locating bases are configured to be aligned and installed in the first elongated openings, which greatly reduces the size of the sliding unit; (ii) the top track has at least two track rods connected together in the sleeved way, which reduces the packaging and shipping costs; (iii) the pulley sets are adapted to slide along the track rods through the guide tracks which have no height difference so as to improve the smoothness of sliding movement of the pulley sets and reduce the noise and damage probability when used; (iv) the outermost of the second sliding base is selectively secured on one of the connecting holes such that the relative position between the outermost of the first sliding base and the locating cover is adjustable so as to increase the shading area of the window curtain; and (v) the positions of the locating bases of the innermost of the first sliding base secured on the top track are adjustable to enable the first sliding base to protrude from the rear end of the top track so as to increase the shading area of the window curtain in the case of limited size of the top track.

BRIEF DESCRIPTION OF THE DRAWINGS

FIG. 13-1 is a partial enlarged drawing of a first mount bar of the shade of window curtain in the present invention.

FIG. 13-2 is a partial enlarged drawing of a bottom track of the shade of window curtain in the present invention.

DETAILED DESCRIPTION OF THE INVENTION

Figure 1:
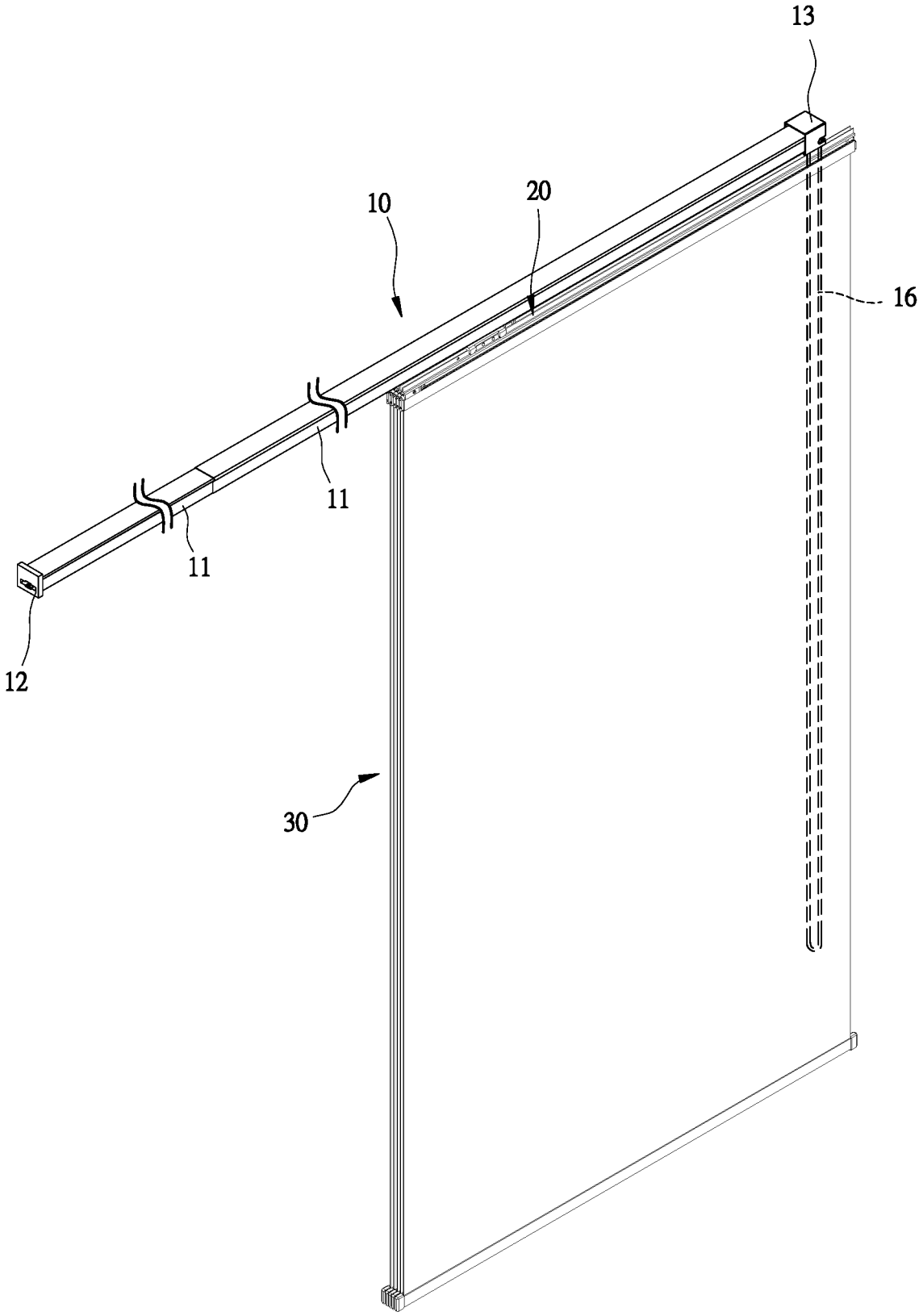
FIG. 1 is a three-dimensional assembly view of a window curtain of the present invention.

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

In order to further understand the goal, characteristics and effect of the present invention, a number of embodiments along with the drawings are illustrated as following:

Referring to FIGS. 1 to 4, the present invention provides a window curtain which comprises a top track (10), at least a sliding unit (20), and a plurality of shades (30). The top track (10) comprises at least two track rods (11) sleeved together, and each of the track rods (11) is hollow to form a channel (111) therein. Moreover, a bottom portion of the channel (111) has a first elongated opening (112), and the channel (111) comprises two vertical guide tracks (113) respectively formed at two lateral edges of the first elongated opening (112) toward an inner space of the channel (111). A locating cover (12) and a cord cap (13) are respectively secured at two ends of the top track (10), and a horizontal accommodating slot (121) is formed inside the locating cover (12). Each of an upper surface and a lower surface of the accommodating slot (121) has a locating recess (122) located at corresponding positions. A wheel (14) is horizontally positioned into the accommodating slot (121), and the position of the wheel (14) is limited by the locating recesses (122). The cord cap (13) comprises two vertical partitions (131) formed therein to form two vertical accommodating spaces (132) in the cord cap (13). Furthermore, a bottom portion of the cord cap (13) has two second elongated openings (133) respectively located at positions corresponding to the two accommodating spaces (132), and a protruded connecting portion (134) is formed between the two second elongated openings (133). Each of the accommodating spaces (132) is adapted to receive a first pulley (15), and a mandrel (151) is adapted to laterally penetrate through the cord cap (13) to pivotally connect the first pulleys (15) with the cord cap (13). A lift cord (16) is disposed between the wheel (14) and the two first pulleys (15), and an end of the lift cord (16) is adapted to pass through the second elongated opening (133) to downwardly hang outside of the cord cap (13). Additionally, the cord cap (13) is secured on an end of the top track (10), and the connecting portion (134) is engaged in the first elongated opening (112), and the connecting portion (134) is cooperated with a first lock piece (135) and a first bolt (136) to secure the cord cap (13) with the top track (10).

Figure 2:
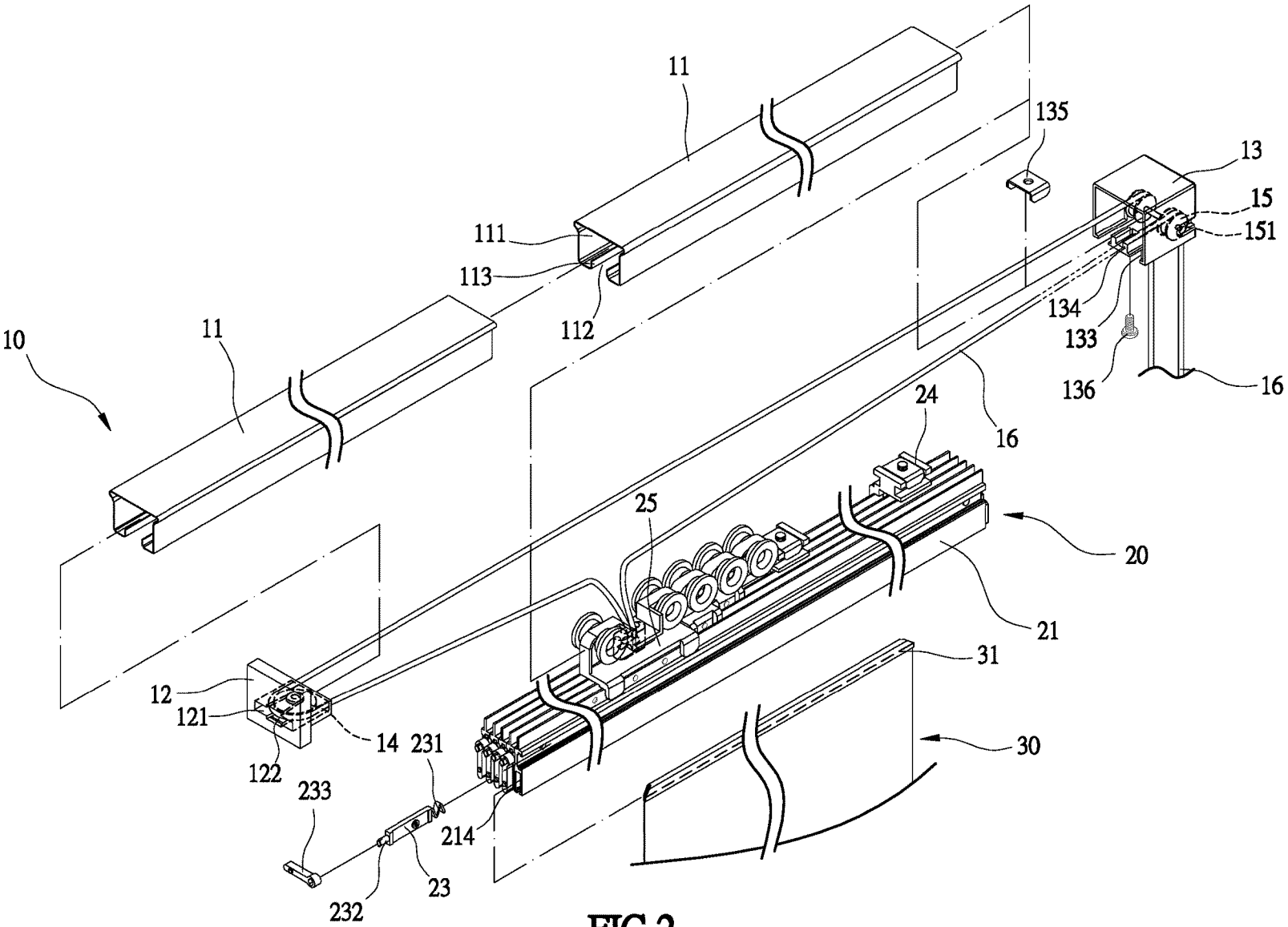
FIG. 2 is a three-dimensional exploded view of the window curtain of the present invention.
Figure 3:
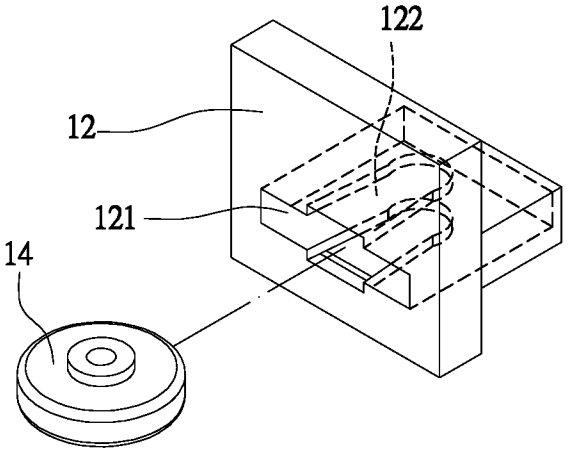
FIG. 3 is an enlarged three-dimensional drawing of a locating cover of the window curtain of the present invention.
Figure 4:
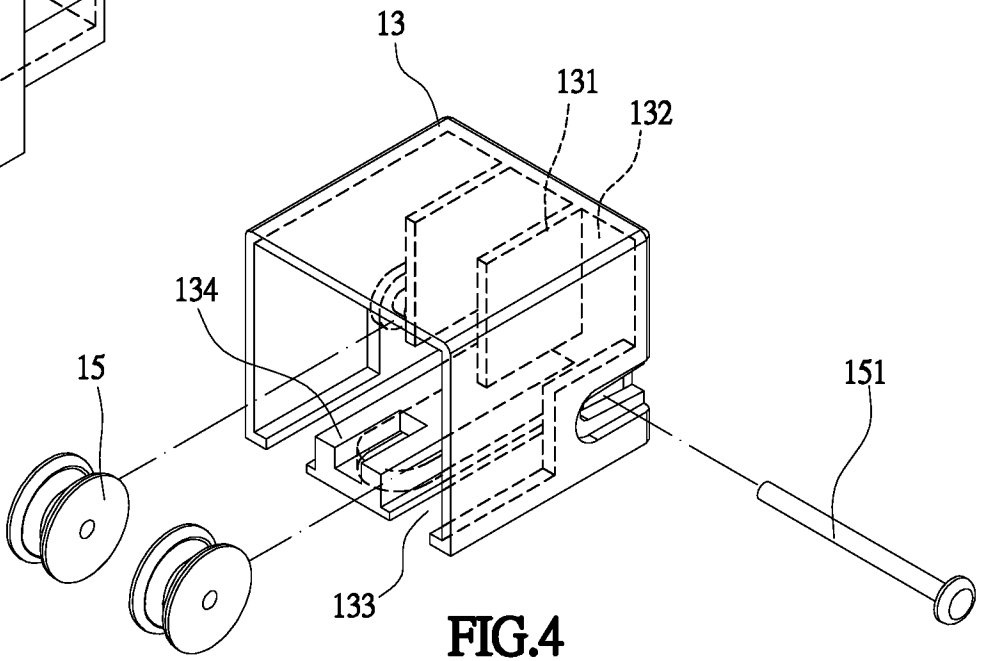
FIG. 4 is an enlarged three-dimensional drawing of a cord cap of the window curtain of the present invention.
Figure 5:
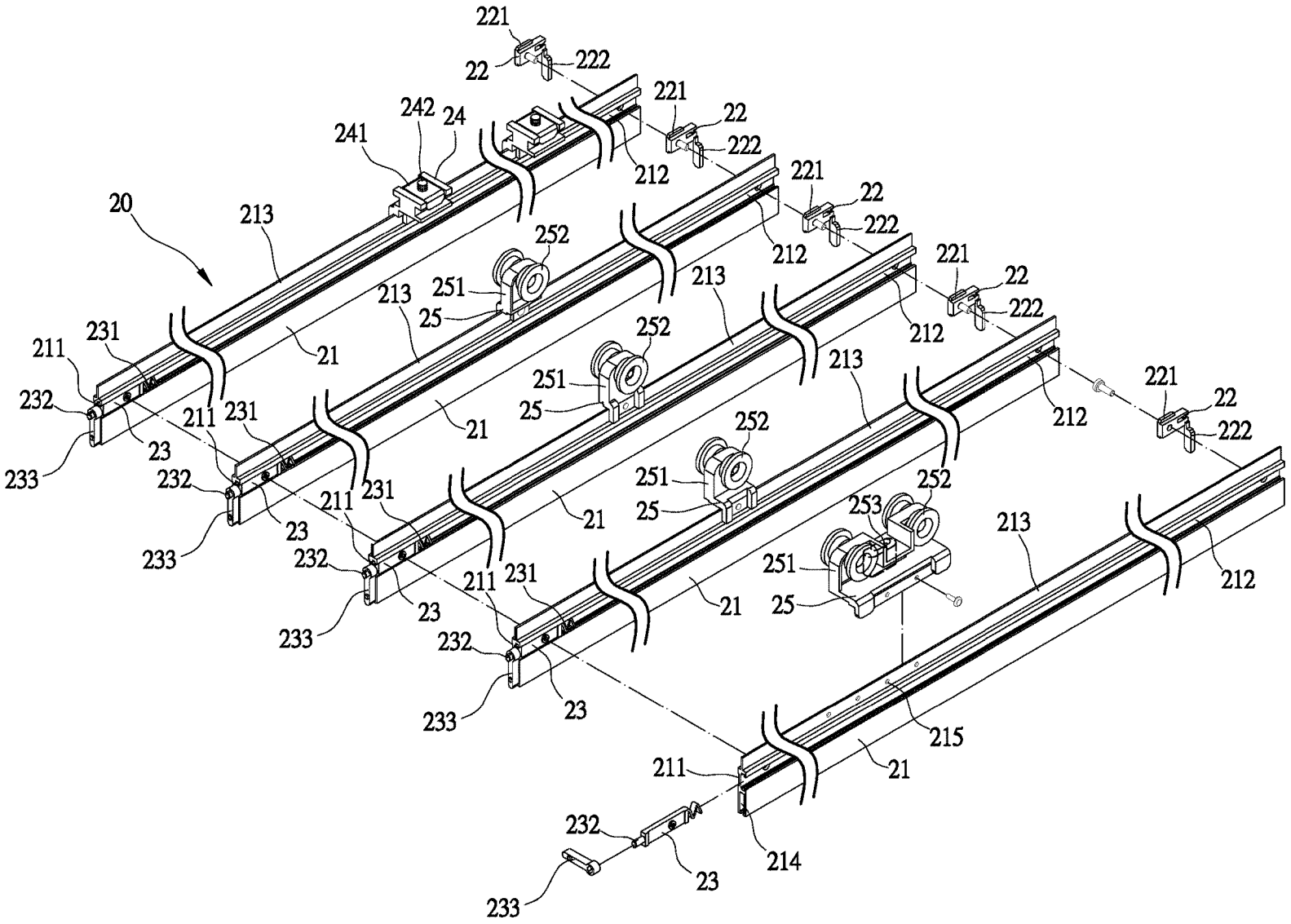
FIG. 5 is an exploded view of a sliding unit of the window curtain of the present invention.
Figure 6:
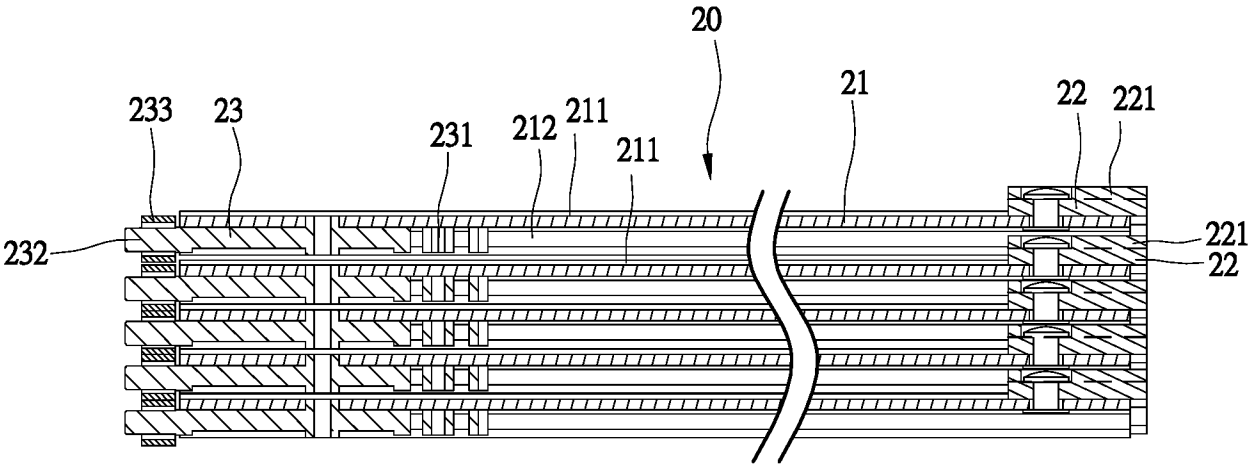
FIG. 6 is a sectional assembly view of the sliding unit of the window curtain of the present invention.
Figure 7:
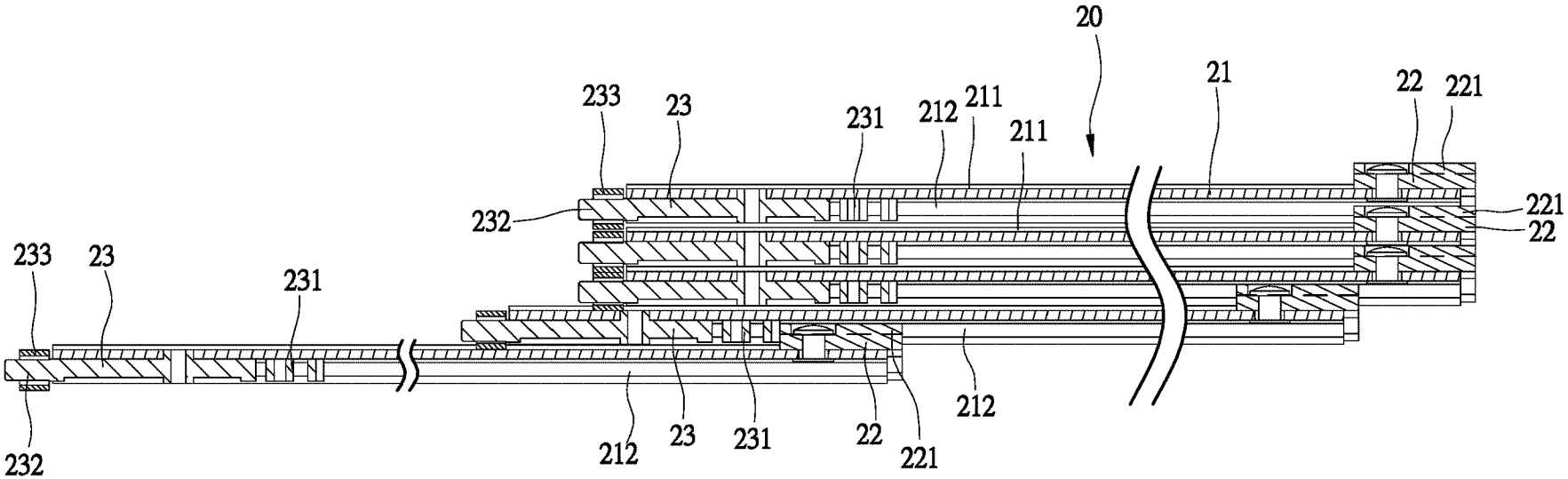
FIG. 7 is a sectional view illustrating the sliding unit of the window curtain is sequentially pulled out in the present invention.
Figure 8:
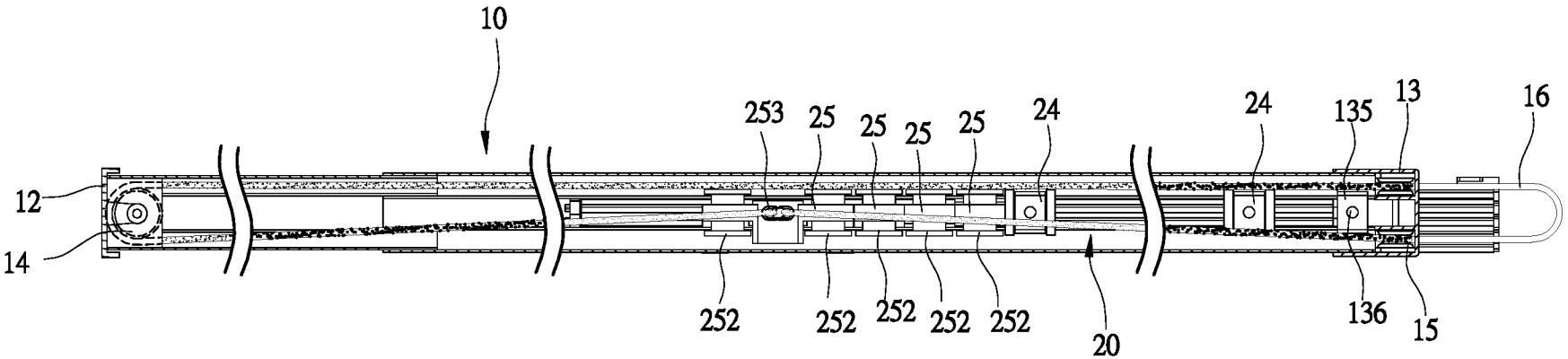
FIG. 8 is a sectional view illustrating the sliding unit is installed on the top track of the window curtain of the present invention.
Figure 10:
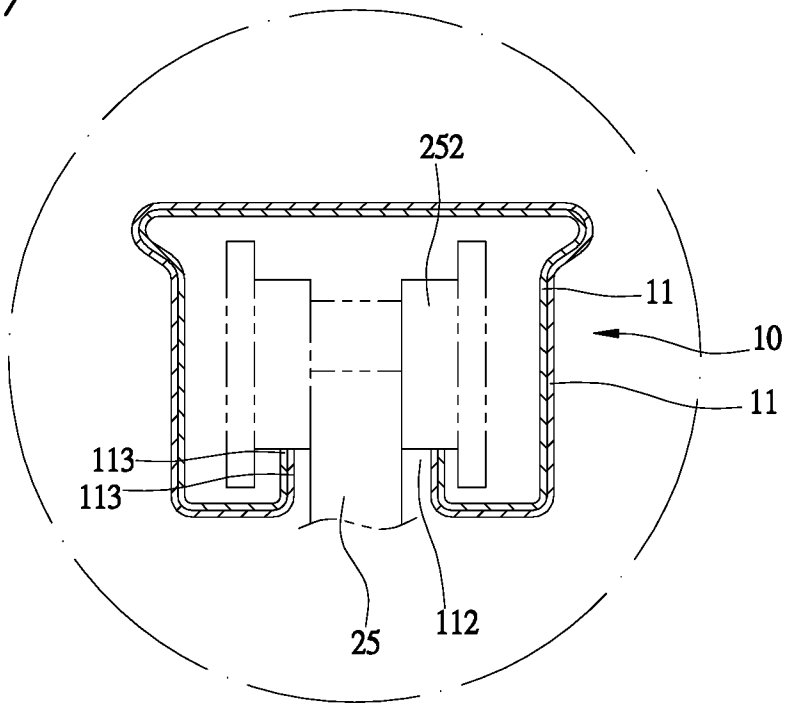
FIG. 10 is a sectional view of FIG. 9 along line A-A.
Figure 9:
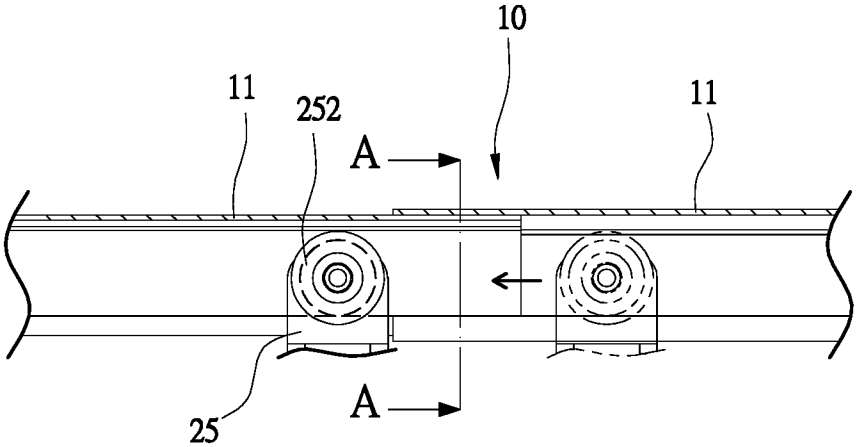
FIG. 9 is a schematic view illustrating a second sliding base slides along the top track of the window curtain of the present invention.

Referring FIGS. 5 to 12, the sliding unit (20) comprises a plurality of first sliding bases (21) formed in parallel, and each of the first sliding bases (21) has two lateral surfaces respectively comprising a first locating groove (211) and a second locating groove (212). Also, a top end of the first sliding base (21) has a connecting board (213) while a bottom end thereof comprises a shade slot (214). In addition, a sliding block (22) is formed at a rear end of the first locating groove (211) which is located close to the cord cap (13), and the thickness of the sliding block (22) is greater than the depth of the first locating groove (211), and an outer end of the sliding block (22) has two locating pieces (221) formed in parallel. The sliding block (22) is slidably coupled in the second locating groove (212) of one adjacent first sliding base (21) through the locating pieces (221). Also, a first blocking piece (222) is extended from a lower end of the sliding block (22) so as to block a rear end of the shade slot (214). A locating block (23) having an elastic buffering piece (231) is formed at a front end of the second locating groove (212) which is located close to the locating cover (12) so as to limit the moving space of the sliding block (22). A front end of the locating block (23) has a column (232) protruding out of the second locating groove (212), and the column (232) is configured to pivotally connect to a second blocking piece (233) which is rotatable to block a front end of the shade slot (214). The connecting boards (213) of the first sliding bases (21) are formed in parallel, and each of the connecting boards (213) comprises at least a connecting hole (215). Moreover, the innermost of first sliding base (21) has two connecting holes (215) and two locating bases (24), and each of the first sliding bases (21) other than the innermost one is connected to a second sliding base (25) through the connecting hole (215). In addition, each of the second sliding bases (25) comprises a pulley support (251), and the lengths of the pulley supports (251) are gradually decreased from the outermost to the innermost one. Furthermore, each of the pulley supports (251) has at least a pulley set (252) installed thereon. The outermost of first sliding base (21) comprises a plurality of connecting holes (215) to enable the corresponding second sliding base (25) to change secured position. The outermost of second sliding base (25) comprises two pulley sets (252) installed thereon, and a through hole (253) formed between the two pulley sets (252) is configured to be passed through by the lift cord (16) for knot. When the first sliding bases (21) of the sliding unit (20) are at unexpanded positions, the second sliding bases (25) with the pulley sets (252) are aligned and coupled one by one (as shown in FIG. 2). One of the locating bases (24) of the innermost of the first sliding base (21) is abutted against the second sliding base (25) of the second from the innermost of the first sliding base (21), and the locating bases (24) and the second sliding bases (25) of the first sliding bases (21) are slidably coupled into the channel (111) of the top track (10). Also, the pulley sets (252) of the second sliding bases (25) are respectively slid along the connected guide tracks (113), and each of the two locating bases (24) of the innermost of the first sliding base (21) is cooperated with a second lock piece (241) and a second bolt (242) to be secured with the guide track (113) of the top track (10).

Referring to FIGS. 13 to 19, each of the shades (30) comprises a first mount bar (31) and a second mount bar (32) respectively formed at an upper end and a lower end of the shade (30), and each of the first mount bars (31) is inserted into the shade slot (214) of the first sliding base (21) while each of the second mount bars (32) is coupled into a bottom track (33). Each of the bottom tracks (33) is formed into a U-shape, and a first slot (331) is formed therein. Moreover, each of two outer lateral sides of the bottom track (33) has an abutting edge (332), and two top ends of the two abutting edges (332) are respectively inwardly bent by 180 degree to form two locating boards (333), and each of the two locating boards (333) is sloped toward each other to enable the abutting edges (332) to be slightly expanded outwardly. Also, an end of the locating board (333) is bent to form a blocking portion (334), and each of two ends of the bottom track (33) is connected to a first cover (34).

Structurally, referring to FIGS. 1 to 19, the track rods (11) of the top track (10) are sleeved, and the length of the top track (10) is adjustable according to a window size by adjusting the sleeved portions of the two track rods (11).

Each of the first sliding bases (21) of the sliding unit (20) has the sliding block (22) formed at the rear end of the first locating groove (211), and the sliding block (22) is adapted to slidably couple in the second locating groove (212) of one adjacent first sliding base (21). Each of the locating blocks (23) is secured at the front end of the second locating groove (212), and the innermost of the first sliding base (21) and each of the others of the first sliding bases (21) are respectively coupled with the top track (10) through the two locating bases (24) and the second sliding base (25). The two locating bases (24) and the second sliding bases (25) are axially aligned and are installed in the channel (111) of the top track (10). The locating bases (24) are respectively abutted against a lower end of the first elongated opening (112), and each of the locating bases (24) is cooperated with one second lock piece (241), the second lock pieces (241) are adapted to cover on top ends of the guide tracks (113). Then, each of the bolt (242) is configured to penetrate through the locating base (24) to engage with the second lock piece (241) so as to secure the innermost of the first sliding base (21) on the top track (10). The pulley sets (252) are coupled on the top ends of the guide tracks (113), and the lift cord (16) is disposed between the wheel (14) of the locating cover (12) and the first pulleys (15) of the cord cap (13). Also, two ends of the lift cord (16) are secured on the through hole (253) of the second sliding base (25) of the outermost of the first sliding base (21), and then the locating cover (12) and the cord cap (13) are respectively coupled on the two ends of the top track (10). Moreover, the connecting portion (134) of the cord cap (13) is cooperated with the first lock piece (135) and the first bolt (136) to firmly abut against the first elongated opening (112) of the top track (10). The lift cord (16) is adapted to pass through the second elongated opening (133) and downwardly hang outside of the cord cap (13) so as to enable a user to operate the sliding unit (20).

In addition, each of the shade slots (214) of the first sliding bases (21) is configured to connect to one shade (30), and the first mount bar (31) of the shade (30), which is formed at the upper end of the shade (30), is inserted into the shade slot (214). Each of the first blocking pieces (222) and each of the second blocking pieces (233), which are located at two ends of the first sliding base (21), are adapted to limit the first mount bar (31) in the shade slot (214) so as to limit the position of the shade (30). The second mount bar (32) of each shade (30) is received in the bottom track (33) and positioned between the first slot (331) and the two locating boards (333), and the two first covers (34) are respectively coupled at the two ends of the bottom track (33). An inner wall of the first cover (34) is abutted against the two abutting edges (332) of the bottom track (33) so as to connect the first cover (34) with the bottom track (33). Meanwhile, the two locating boards (333) of the bottom track (33) are sloped inwardly, and the two blocking portions (334) of the locating boards (333) are abutted against a top end of the second mount bar (32) so as to secure the bottom track (33) at the lower end of the shade (30), thereby completing the assembly of each shade (30).

In actual application, referring to FIGS. 1, 5, 6, and 20, the window curtain of the present invention is installed on a wall above a window or a French window through the top track (10) for indoor light adjustment. When the shades (30) are at the unexpanded position, the shades (30) driven by the first sliding bases (21) of the sliding unit (20) are positioned at one end of the top track (10), and the first sliding bases (21) together with the shades (30) are located in parallel. When the shades (30) need to be expanded, a user can pull the lift cord (16) to rotate the first pulleys (15) in one direction, and the first sliding bases (21) are sequentially pulled out and slid along the connected guide tracks (113) from the outermost of the first sliding base (21). Meanwhile, the sliding block (22) of the first locating groove (211) on the outermost of the first sliding base (21) is slid along the second locating groove (212) of the second from the outermost of the first sliding base (21) and then abutted against the locating block (23) of the second from the outermost of the first sliding base (21) so as to drive the second from the outermost of the first sliding base (21) out, and the first sliding bases (21) are driven and slid out one by one along the first elongated openings (112) to achieve the shading effect. Also, the locating bases (24) of the innermost of the first sliding base (21) are secured on the top track (10) such that the innermost of the first sliding base (21) is not moved.

Figure 16:
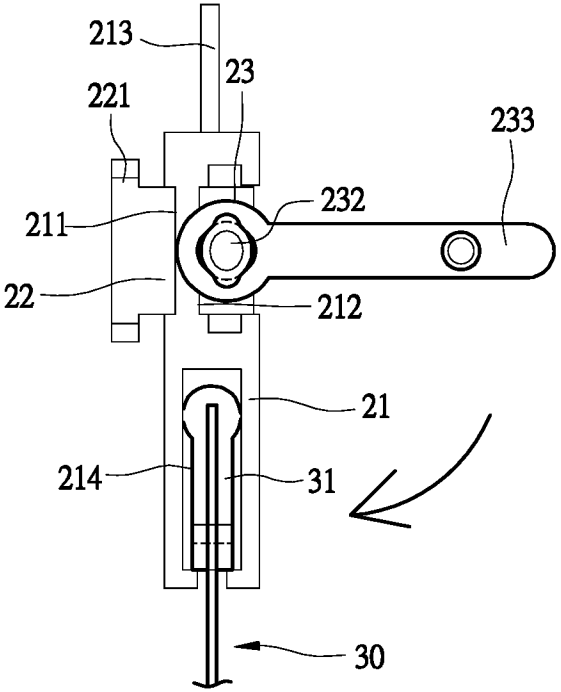
FIG. 16 is a schematic view illustrating the first mount bar of the shade is coupled in a shade slot of a first sliding base of the window curtain in the present invention.
Figure 19:
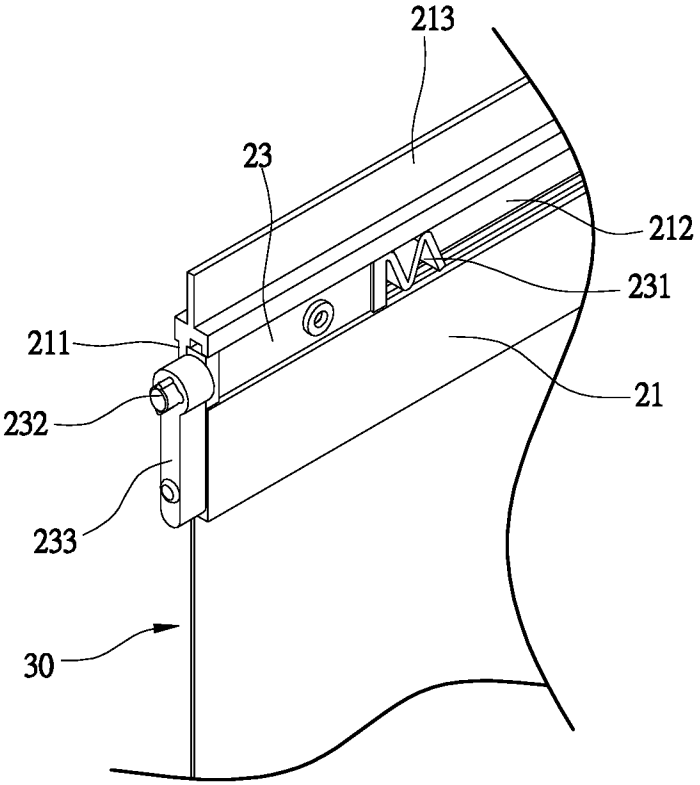
FIG. 19 is a three-dimensional view illustrating the position of the shade is limited by the second blocking piece of the window curtain in the present invention.
Figure 18:
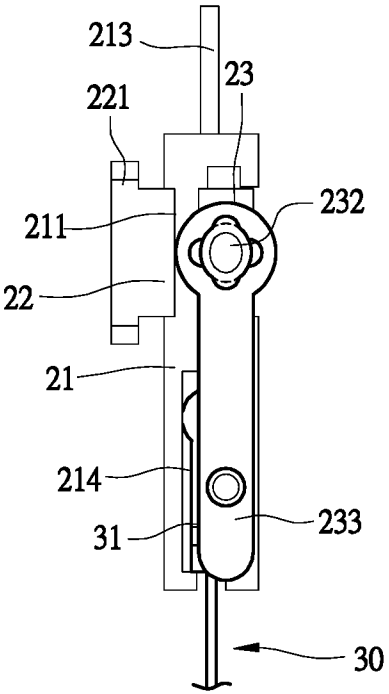
FIG. 18 is a schematic view illustrating the position of the shade is limited by a second blocking piece of the window curtain in the present invention.

On the other hand, when the expanded shades (30) need to be unexpanded, a user can pull the lift cord (16) to rotate the first pulleys (15) in the other direction, and the first sliding bases (21) are adapted to be sequentially slid back along the connected guide tracks (113) from the outermost of the first sliding base (21). At this time, the second sliding base (25) of the outermost of the first sliding base (21) is configured to abut against the second sliding base (25) of the second from the outermost of the first sliding base (21) so as to sequentially move the first sliding bases (21) back to theirs initial unexpanded positions (as shown in FIG. 16).

Figure 11:
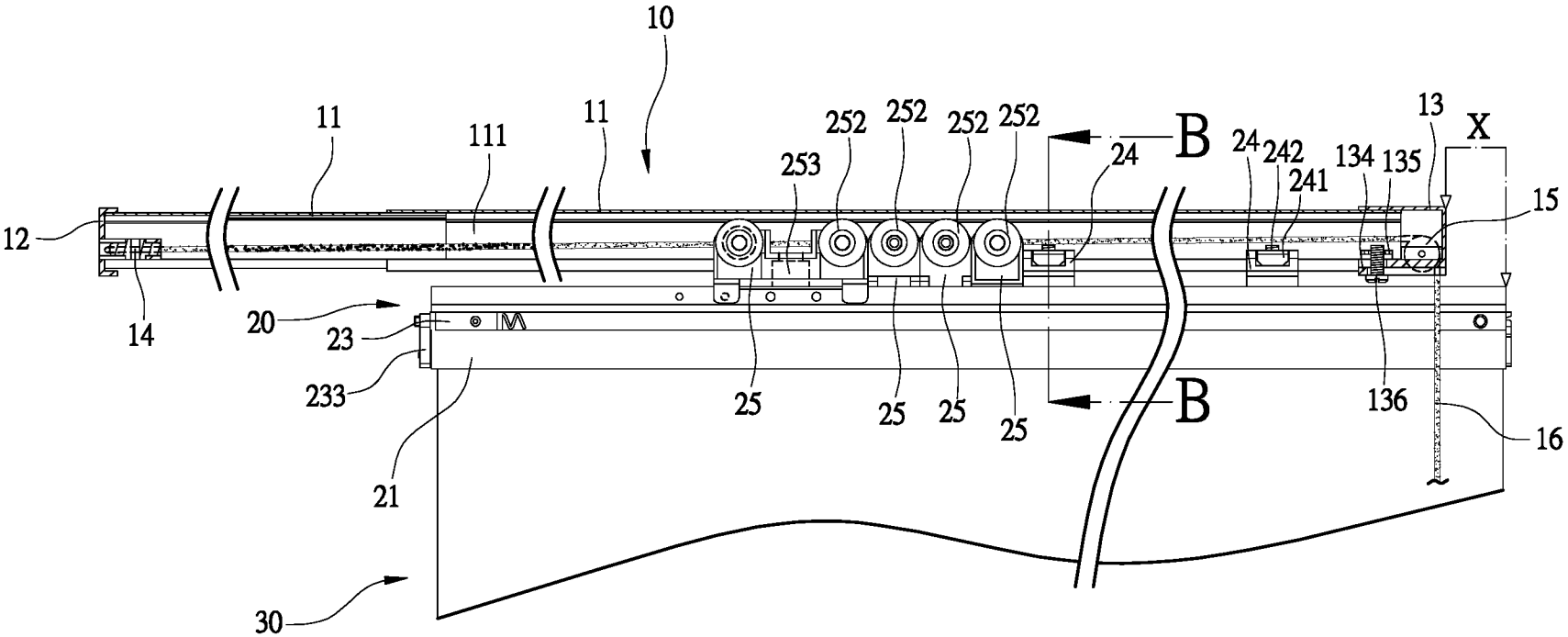
FIG. 11 is a sectional view from another angle illustrating the sliding unit is installed on the top track of the window curtain of the present invention.
Figure 12:
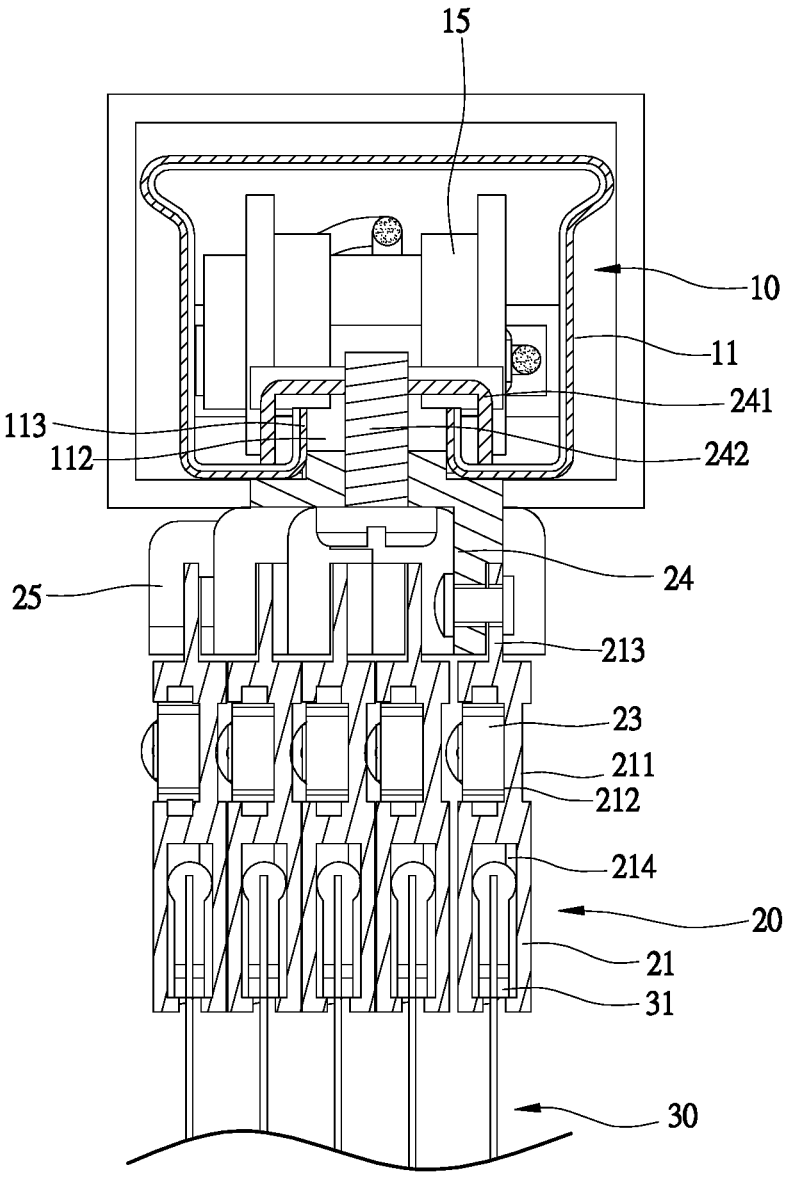
FIG. 12 is a sectional view of FIG. 11 along line B-B.
Figures 1, 2, 13:
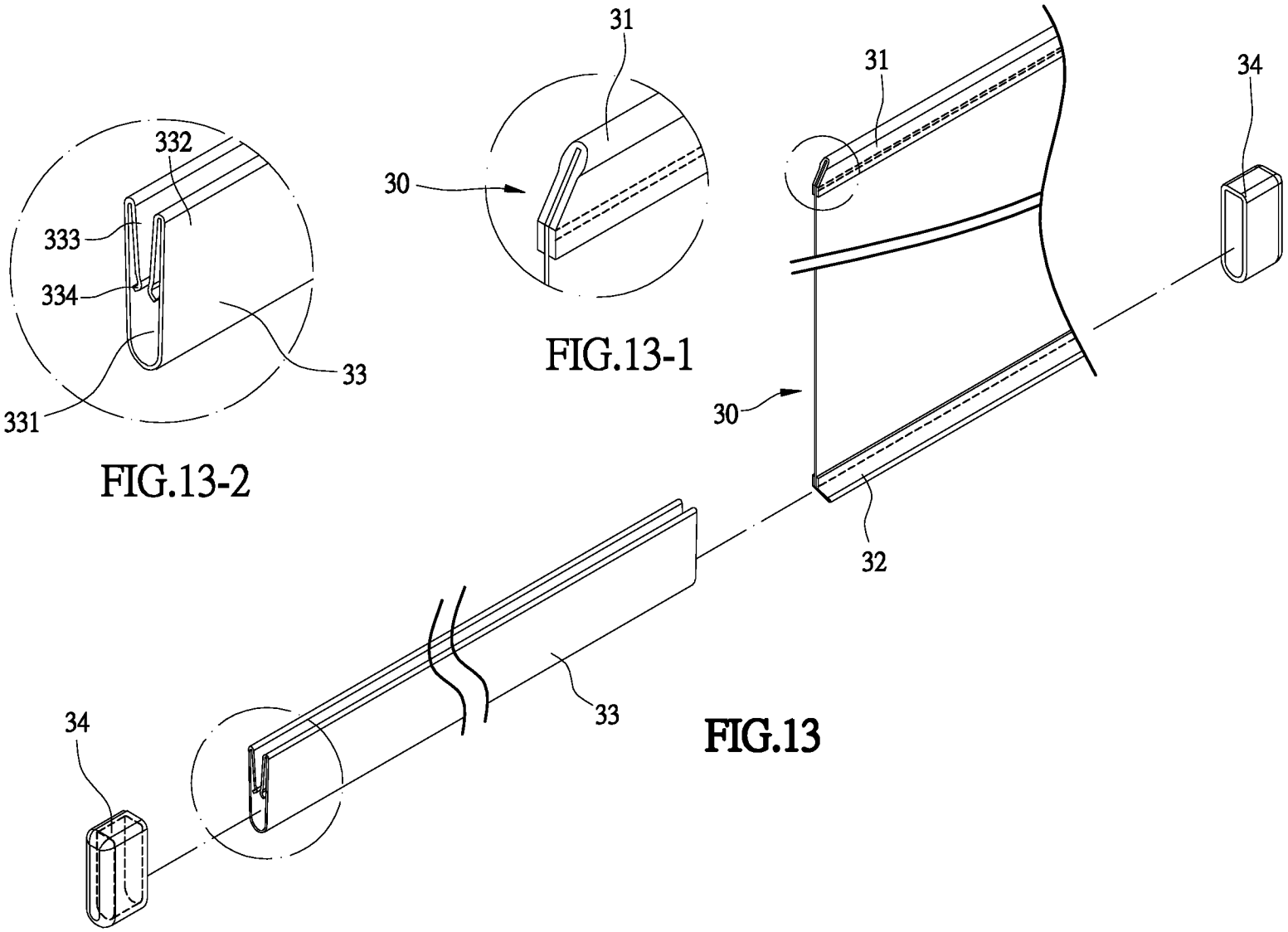
FIG. 13 is an enlarged drawing of a shade of the window curtain of the present invention.
Figure 15:
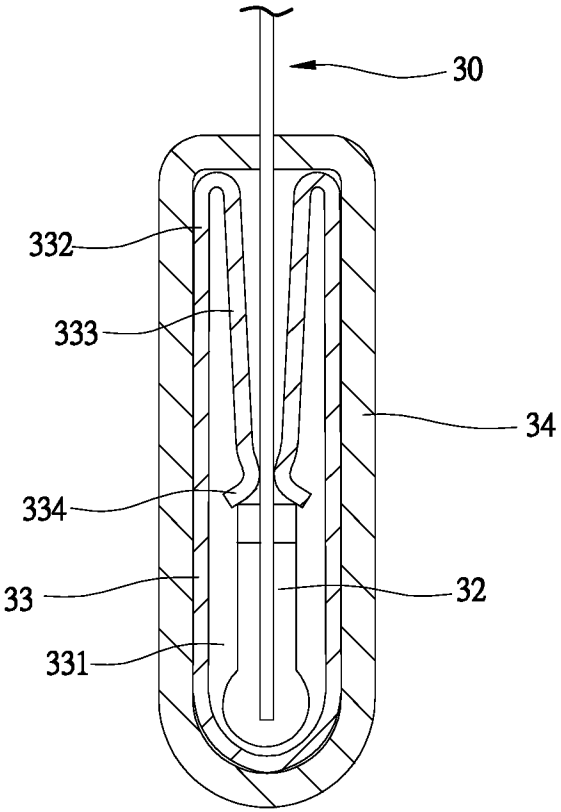
FIG. 15 is a sectional view illustrating a first cover couples on the bottom track of the shade of the window curtain in the present invention.
Figure 14:
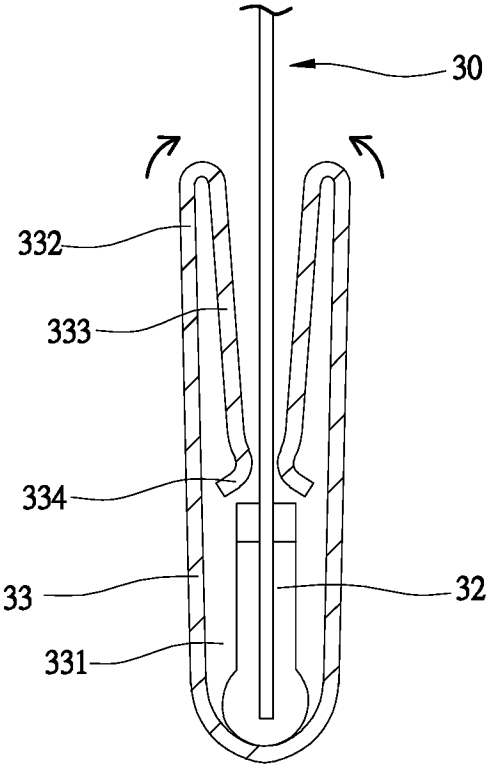
FIG. 14 is an exploded view illustrating the bottom track disposed on a second mount bar of the shade of the window curtain in the present invention.
Figure 17:
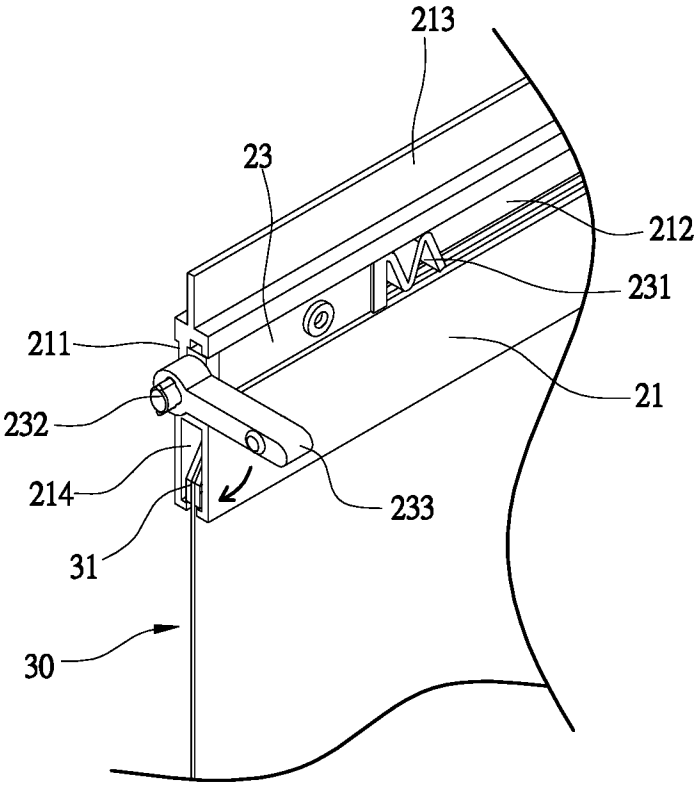
FIG. 17 is a three-dimensional view illustrating the first mount bar of the shade is coupled in the shade slot of the first sliding base of the window curtain in the present invention.
Figure 20:
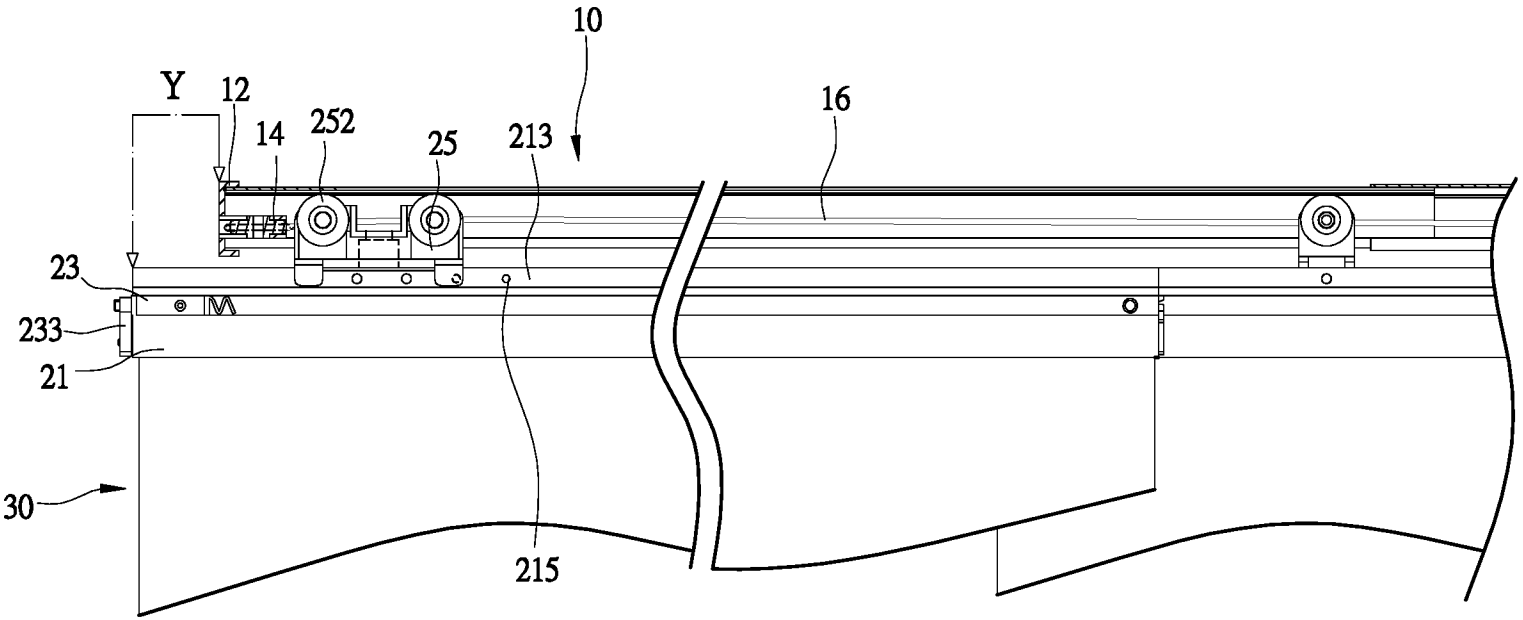
FIG. 20 is a schematic view illustrating the window curtain of the present invention is at an expanded position.
Figure 21:
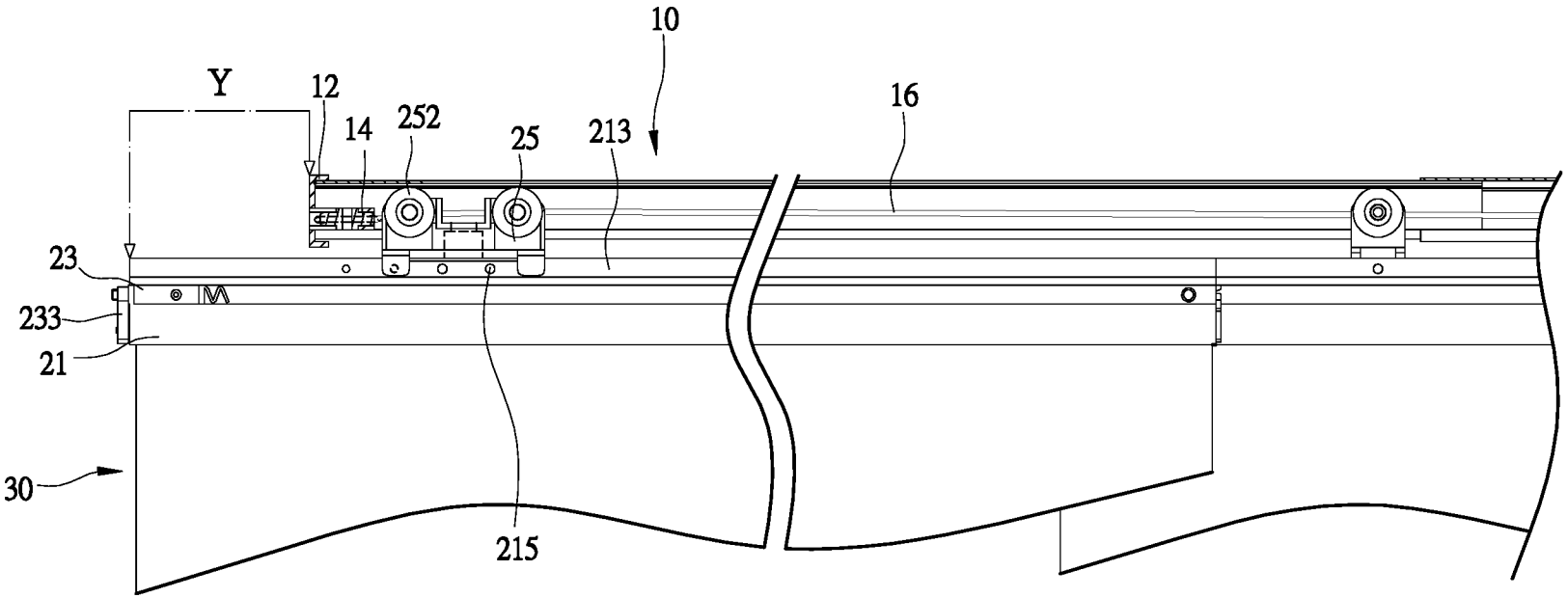
FIG. 21 is a schematic view illustrating the window curtain of the present invention is at an expanded position after the position of the second sliding base is adjusted.
Figure 22:
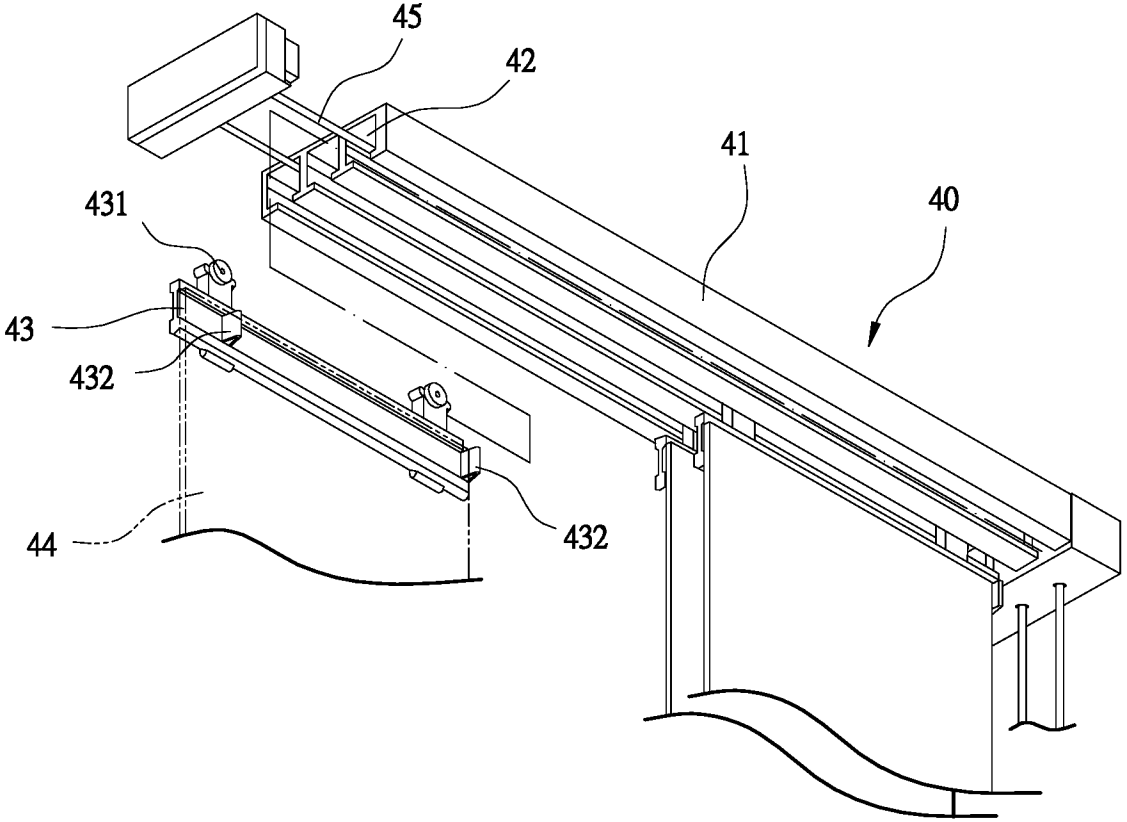
FIG. 22 PRIOR ART
FIG. 22 is a prior art.
Figure 23:
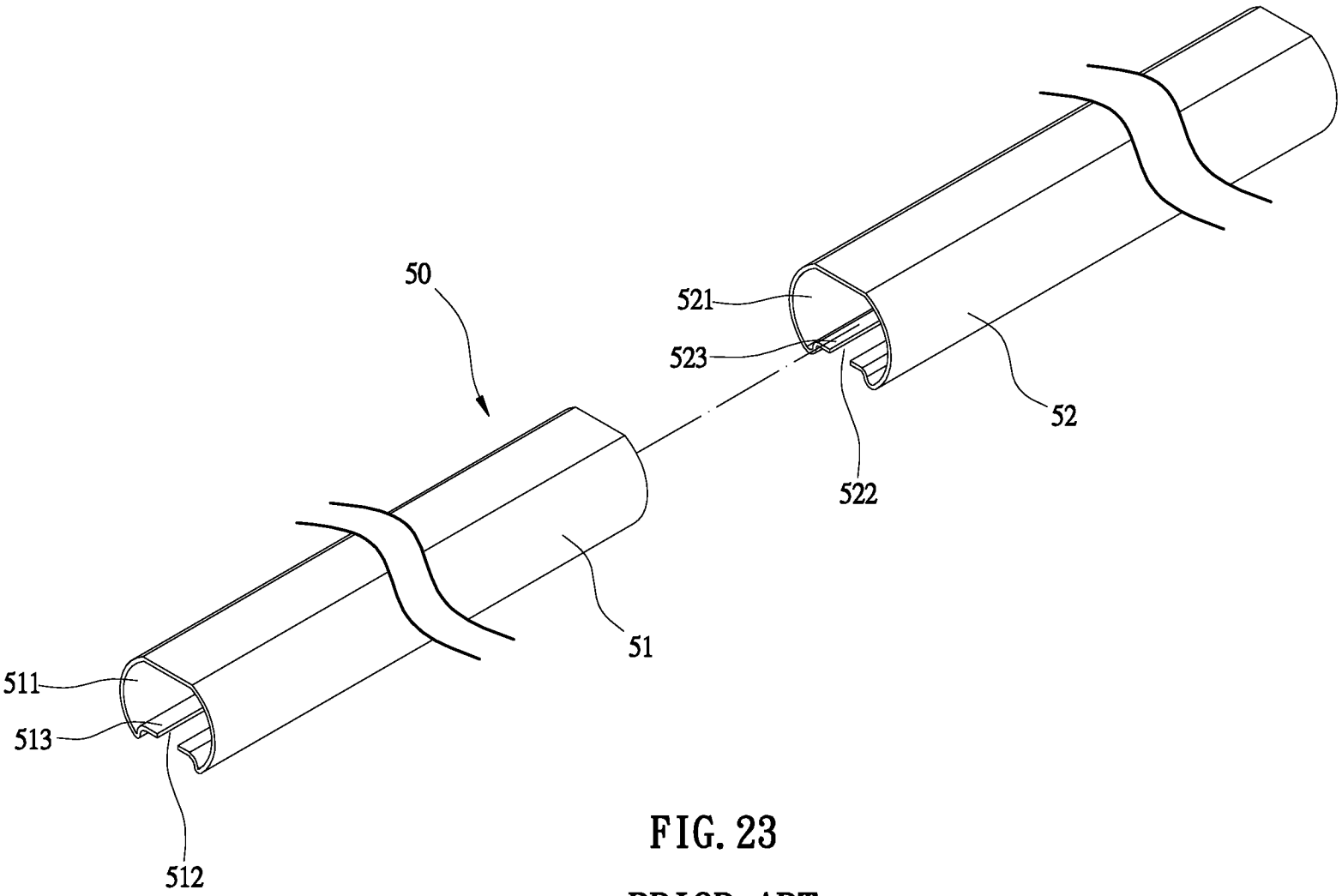
FIG. 23 PRIOR ART
FIG. 23 is a prior art.
Figure 25:
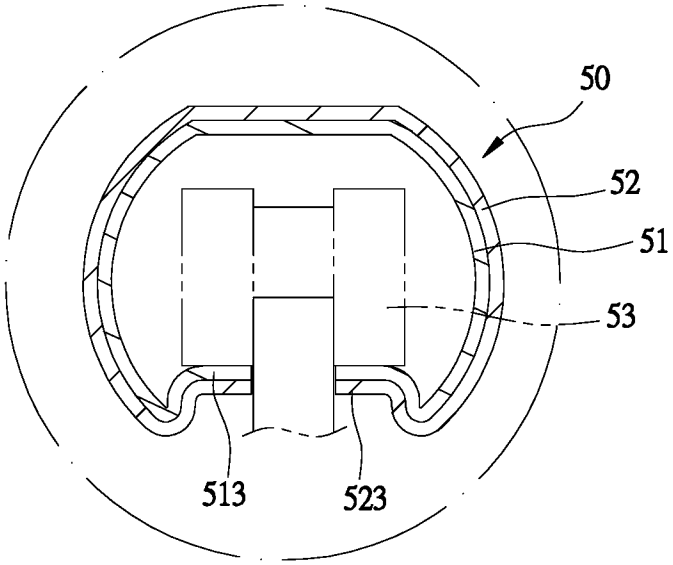
FIG. 25 PRIOR ART
FIG. 25 is a prior art.
Figure 24:
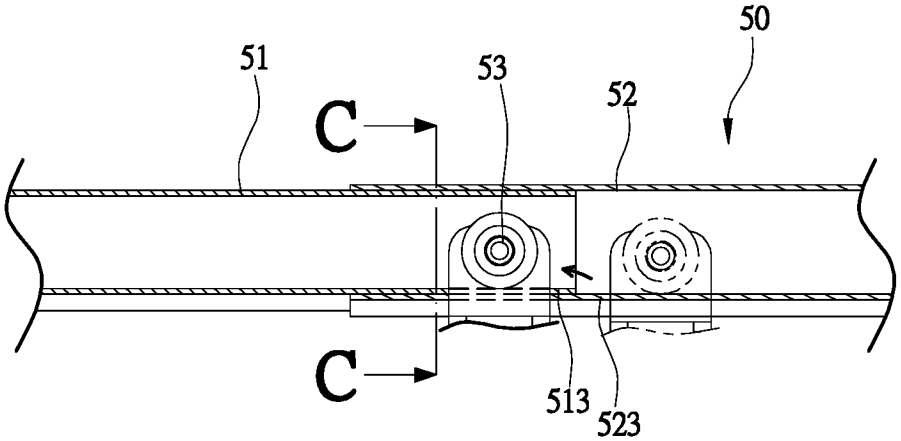
FIG. 24 PRIOR ART
FIG. 24 is a prior art.

Additionally, the connecting board (213) of the outermost of the first sliding base (21) comprises a plurality of connecting holes (215) to enable the second sliding base (25) thereof to adjust its position. When the outermost of the first sliding base (21) is moved during the unexpanded process, the second sliding base (25) thereof is secured at a position abutted against the locating cover (12) such that when the secured position of the second sliding base (25) is moved toward a middle portion of the connecting board (213) (as shown in FIGS. 20 and 21), the distance between the second sliding base (25) and the locating cover (12) is increased. As a result, when at expanded position, the outermost of the first sliding base (21) is adapted to protrude from a front end of the top track (10) so as to increase the shading area of the window curtain, and the extending length (Y) of the increased shading area is shown in FIGS. 20 and 21. Furthermore, when the secured position of the locating bases (24) of the innermost of the first sliding base (21) is closer to the cord cap (13), the innermost of the first sliding base (21) is adapted to protrude from a rear end of the top track (10) so as to increase the shading area of the window curtain, and the extending length (X) of the increased shading area is shown in FIG. 11. Thus, the window curtain of the present invention can achieve a better shading effect in the case of limited size of the top track (10).

Comparing with conventional window curtain, the present invention is advantageous because: (i) with the different lengths of pulley supports (251), the pulley sets (252) and the locating bases (24) are configured to be aligned and installed in the first elongated openings (112), which greatly reduces the size of the sliding unit (20); (ii) the top track (10) has at least two track rods (11) connected together in the sleeved way, which reduces the packaging and shipping costs; (iii) the pulley sets (252) are adapted to slide along the track rods (11) through the guide tracks (113) which have no height difference so as to improve the smoothness of sliding movement of the pulley sets (252) and reduce the noise and damage probability when used; (iv) the outermost of the second sliding base (25) is selectively secured on one of the connecting holes (215) such that the relative position between the outermost of the first sliding base (21) and the locating cover (12) is adjustable so as to increase the shading area of the window curtain; and (v) the positions of the locating bases (24) of the innermost of the first sliding base (21) secured on the top track (10) are adjustable to enable the first sliding base (21) to protrude from the rear end of the top track (10) so as to increase the shading area of the window curtain in the case of limited size of the top track (10).

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A window curtain comprising a top track, at least a sliding unit, and a plurality of shades;

wherein the top track comprises at least two track rods sleeved together, and each of the track rods is hollow to form a channel therein; a bottom portion of the channel has a first elongated opening, and the channel comprises two vertical guide tracks respectively formed at two lateral edges of the first elongated opening toward an inner space of the channel; a locating cover and a cord cap are respectively secured at two ends of the top track, and a horizontal accommodating slot is formed inside the locating cover; each of an upper surface and a lower surface of the accommodating slot has a locating recess located at corresponding positions, and a wheel is horizontally positioned into the accommodating slot, and the position of the wheel is limited by the locating recesses; the cord cap comprises two vertical partitions formed therein to form two vertical accommodating spaces in the cord cap, and a bottom portion of the cord cap has two second elongated openings respectively located at positions corresponding to the two accommodating spaces, and a protruded connecting portion is formed between the two second elongated openings; each of the accommodating spaces is adapted to receive a first pulley, and a mandrel is adapted to laterally penetrate through the cord cap to pivotally connect the first pulleys with the cord cap; a lift cord is disposed between the wheel and the two first pulleys, and an end of the lift cord is adapted to pass through the second elongated opening to downwardly hang outside of the cord cap; the cord cap is secured on an end of the top track, and the connecting portion is engaged in the first elongated opening, and the connecting portion is cooperated with a first lock piece and a first bolt to secure the cord cap with the top track;

wherein the sliding unit comprises a plurality of first sliding bases formed in parallel including an innermost first sliding base and an outermost sliding base, and each of the first sliding bases has two lateral surfaces respectively comprising a first locating groove and a second locating groove; a top end of the first sliding base has a connecting board while a bottom end thereof comprises a shade slot; a sliding block is formed at a rear end of the first locating groove and the thickness of the sliding block is greater than the depth of the first locating groove; the sliding block is slidably coupled in the second locating groove of one adjacent first sliding base; a locating block having an elastic buffering piece formed at a front end of the second locating groove to limit the moving space of the sliding block; a front end of the locating block is pivotally connected to a second blocking piece, said second blocking piece is rotatable to block a front end of the shade slot; the connecting boards of the first sliding bases are formed in parallel, and each of the connecting boards comprises at least a connecting hole; the innermost first sliding base has two connecting holes and two locating bases, and each of other first sliding bases is connected to a second sliding base through the connecting hole; each of the second sliding bases comprises a pulley support, and each of the pulley supports has at least a pulley set installed thereon; the outermost first sliding base comprises a plurality of connecting holes to enable the corresponding second sliding base to change secured position; an outermost of second sliding base comprises two pulley sets installed thereon, and a through hole formed between the two pulley sets is configured to be passed through by the lift cord for knot; when the first sliding bases of the sliding unit are at unexpanded positions, the second sliding bases with the pulley sets are aligned and coupled one by one; one of the locating bases of the innermost first sliding base is abutted against the second sliding base, and the locating bases and the second sliding bases of the first sliding bases are slidably coupled into the channel of the top track; the pulley sets of the second sliding bases are respectively slid along the connected guide tracks, and each of the two locating bases of the innermost first sliding base is cooperated with a second lock piece and a second bolt to be secured with the guide track of the top track; and wherein each of the shades comprises a first mount bar and a second mount bar respectively formed at an upper end and a lower end of the shade, and each of the first mount bars is inserted into the shade slot of the first sliding base while each of the second mount bars is coupled into a bottom track; each of the bottom tracks is formed into a U-shape, and a first slot is formed therein; each of two outer lateral sides of the bottom track has an abutting edge, and two top ends of the two abutting edges are respectively inwardly bent to form two locating boards, and each of the two locating boards is sloped toward each other to enable the abutting edges to be slightly expanded outwardly; and an end of the locating board is bent to form a blocking portion, and each of two ends of the bottom track is connected to a first cover.

2. The window curtain of claim 1, wherein an outer end of the sliding block has two locating pieces formed in parallel, and the sliding block is slidably coupled in the second locating groove of one adjacent first sliding base through the locating pieces, and a first blocking piece is extended from a lower end of the sliding block so as to block a rear end of the shade slot.

3. The window curtain of claim 1, wherein the front end of the locating block has a column protruding out of the second locating groove, and the column is configured to pivotally connect to the second blocking piece.

* * * * *